US011088430B2

(12) United States Patent
Guess

(10) Patent No.: US 11,088,430 B2
(45) Date of Patent: Aug. 10, 2021

(54) RADIO FREQUENCY RESONATORS WITH BRIDGE COUPLING ADJACENT RESONATORS

(71) Applicant: Huawei Technologies Co., Ltd., Shenzhen (CN)

(72) Inventor: Michael Guess, Kista (SE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/551,232

(22) Filed: Aug. 26, 2019

(65) Prior Publication Data

US 2019/0386366 A1 Dec. 19, 2019

Related U.S. Application Data

(63) Continuation of application No. PCT/EP2017/054512, filed on Feb. 27, 2017.

(51) Int. Cl.
*H01P 1/20* (2006.01)
*H01P 1/208* (2006.01)

(52) U.S. Cl.
CPC ..... *H01P 1/2088* (2013.01); *H01P 1/2002* (2013.01); *H01P 1/2086* (2013.01)

(58) Field of Classification Search
CPC ..... H01P 1/2002; H01P 1/20; H01P 1/208; H01P 1/2082; H01P 1/2084; H01P 1/2086; H01P 5/12; H01P 5/16
USPC ..... 333/212, 208, 209, 202
See application file for complete search history.

(56) References Cited

U.S. PATENT DOCUMENTS

| | | | |
|---|---|---|---|
| 6,002,306 | A | 12/1999 | Arakawa |
| 6,002,307 | A | 12/1999 | Arakawa |
| 6,133,808 | A | 10/2000 | Arakawa |
| 2005/0128031 | A1 | 6/2005 | Wilber et al. |

FOREIGN PATENT DOCUMENTS

| | | | |
|---|---|---|---|
| CN | 1419311 | A | 5/2003 |
| EP | 3046179 | A1 | 7/2016 |
| JP | H04287501 | A | 10/1992 |
| WO | 201514949 | A1 | 8/2015 |

OTHER PUBLICATIONS

Matthaei et al.,"Microwave Filters, Impedance-Matching Networks, and Coupling Structures," Artech House Inc., Norwood, MA (1964).

*Primary Examiner* — Stephen E. Jones
(74) *Attorney, Agent, or Firm* — Leydig, Voit & Mayer, Ltd.

(57) ABSTRACT

An iris bridge for coupling two radio frequency resonators includes: a body of dielectric material having an exposed first surface area, having a predetermined length, width and thickness, and having an elongate shape along the length of the body; a hole disposed through the body along the width of the body, the hole having a wall forming a second surface area of the body; and a conductive coating covering the exposed first surface area of the body and a first portion of the second surface area of the body. A second portion of the second surface area is free of conductive coating forming a non-conductive section of the wall of the hole. Such bridge may be tuned for coupling radio frequency resonators.

14 Claims, 7 Drawing Sheets

RADIO FREQUENCY RESONATORS WITH BRIDGE COUPLING ADJACENT RESONATORS

CROSS-REFERENCE TO RELATED APPLICATIONS

Figure 1A:
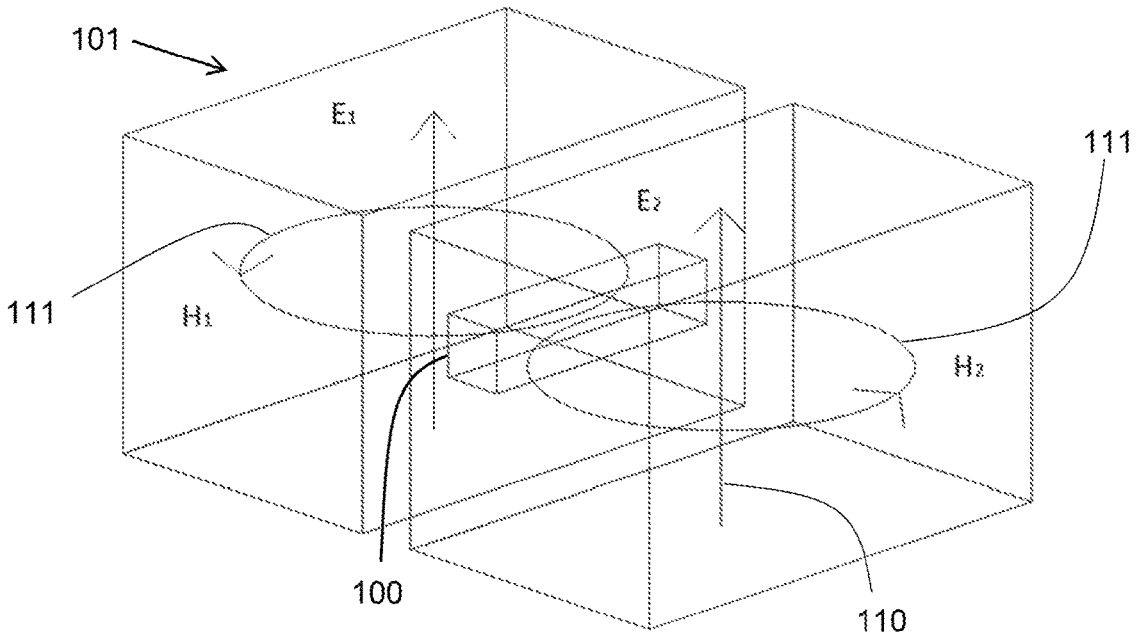

This application is a continuation of International Application No. PCT/EP2017/054512, filed on Feb. 27, 2017, the disclosure of which is hereby incorporated by reference in its entirety.

TECHNICAL FIELD

Embodiments of the present application relate to the field of radio frequency resonators and methods for tuning radio frequency resonators.

BACKGROUND

As radios become more compact and integrated there is renewed demand to produce low-loss, high-power filters that are low volume or have a small form-factor. Primarily, this is to enable components to be tightly packed and used in conjunction with large antenna arrays for multiple-input and multiple-output (MIMO) systems. Prior to final assembly in such a radio system, the filter components require configuration in the form of frequency and bandwidth alignment, so that it meets the required specification.

Metal or dielectric screws have been used to perturb electromagnetic fields for frequency or bandwidth adjustment in a variety of filter types. For example, a mechanical or discrete nut and screw component can be used with air-cavity filters and solid dielectric resonators. The nature of highly dielectric material used results in small filters compared to the equivalent air-cavity filters, which therefore requires even smaller components for a tuning mechanism. In addition to this, an effective contact must be maintained between discrete tuning elements and the ground of the filter itself, which can be completely covered in conductive coating. This creates a problem with mechanical complexity and requires a larger area for tool access (e.g. to a nut), also introducing the possibility of damaging the part during alignment.

The above makes the accurate configuration and integration of solid dielectric multi-mode filters problematic and may preclude their adoption in commercial radio systems.

SUMMARY

An object of embodiments of the present application is to provide a bridge for coupling two radio frequency resonators which at least partially resolves one or more problems of the prior art.

Another object of embodiments of the present application is to provide a system of at least two radio frequency resonators in which coupling between resonant modes of adjacent resonators may be tuned.

Another object of embodiments of the present application is to provide a method for tuning a bridge for coupling two radio frequency resonators.

According to a first aspect, a bridge for coupling two radio frequency resonators is provided. The bridge may be an iris bridge or any other type of bridge that allows coupling of two adjacent resonators. The bridge comprises a body of dielectric material having an exposed first surface area, having predetermined length, width and thickness, and having an elongate shape along the length of the body. When the bridge is used for coupling two radio frequency resonators and placed between them accordingly, adjacent surfaces of the resonators can be attached to the bridge along the width from opposite sides thereof. The bridge may have a parallelepiped shape and include multiple surface areas, in which case the two resonators may be attached to opposite surface areas along the width of the body of the bridge. The exposed first surface area relates to parts of the surface of the body that are not touching either of the two resonators.

The bridge further comprises a hole disposed through the body along the width of the body, the hole having a wall forming a second surface area of the body. The wall is the inner wall of the hole, so the second surface area can be referred to as the inner surface of the hole.

The bridge further comprises a conductive coating covering the exposed first surface area of the body and a first portion of the second surface area of the body; wherein a second portion of the second surface area is free of conductive coating forming a non-conductive section of the of the wall of the hole.

The conductive coating is formed of a highly conductive material. The conductive material can be a metal. The surface areas covered by the conductive layer provide an additional electrical ground plane that is external to the bridge.

The non-conductive section of the wall of the hole in combination with the conductively coated first portion of the second surface area inside the hole form a resonant structure, as described below in further detail.

The bridge according to the first aspect enables the coupling of at least two modes in separate but adjacent resonators to be precisely controlled. The control provided by an embodiment of the disclosure allows for manufacture of a full radio frequency filter out of a single piece of dielectric material, such as ceramic. The coupling between resonators of the filter can be provided through an integral bridge as described herein.

The bridge may be a bridge for coupling two single-mode, dual-mode or multimode radio frequency resonators. The bridge may have a shape of an elongate parallelepiped or any other elongate shape appropriate to the design of the system. An elongate shape refers to a shape wherein the length is larger than the width and thickness.

In a first possible implementation form of a bridge according to the first aspect, the non-conductive section of the hole extends from an edge of the hole into the hole. The non-conductive section of the hole thereby "starts" at the edge of the hole. This forms a post wherein its existing boundary condition can change with the post becoming an open-circuit stub, resonant at a frequency different from either of the frequencies of the modes to be coupled. The coupling can then be adjusted based on the proportion of the first and second portions (conductive and non-conductive areas) of the second surface area.

In a second possible implementation form of a bridge according to the first aspect as such or any implementation form thereof, the hole is disposed through a central area of the body. The hole disposed through a central area can have a higher impact on the coupling since the coupling is strongest in the central portion of the bridge when the bridge is positioned in a central area between adjacent surfaces of the two resonators.

In a third possible implementation form of a bridge according to the first aspect as such or any implementation form thereof the hole is disposed through an area offset from the center of the body. This may be desirable if lower sensitivity of coupling adjustment would be required. This implementation may also be appropriate for certain design considerations wherein the bridge body has higher length.

In a fourth possible implementation form of a bridge according to the first as such or any implementation form thereof, the hole has a cylinder shape, and the diameter of the cylinder is smaller than the thickness of the body.

In a fifth possible implementation form of a bridge according to the first implementation form of the first aspect, the hole has a shape of a cylinder with a conical top near the edge of the hole from which the non-conductive section of the wall of the hole extends into the hole.

A cylindrical hole can be easier to manufacture. A hole with conical frustum shape provides better access for partial removal of conductive coating from its surface area.

In a fourth possible implementation form of a bridge according to the first aspect as such or any implementation form thereof, the second portion of the second surface area covers at least 25% of the wall of the hole. Removing conductive coating causes the amount of coupling between two modes of the resonators to reduce. After 25% of the conductive coating is removed from the surface area, the relation between post height and amount of coupling becomes substantially linear, which provides optimal control.

In a seventh possible implementation form of a bridge according to the first aspect as such or any implementation form thereof, the body comprises an additional elongated part orthogonal to the elongated shape along the length of the body. The additional elongated part comprises an additional hole disposed through the additional elongated part, and the additional hole is orthogonal and symmetrical to the original hole disposed through the body along the width of the body. In this implementation, according to the third implementation, the original hole is disposed through an area offset from the center of the body. This provides room for the additional elongated part of the body, which can be orthogonal to the length of the main part of the body. The orthogonal holes in the bridge allows it to couple two orthogonal modes of the adjacent resonators, in the case the adjacent resonators are dual-mode or multimode radio frequency resonators.

In an eighth possible implementation form of a bridge according to the first aspect as such or any implementation form thereof, the bridge comprises two or more holes disposed through the body along the width of the body. This configuration may be preferable for finer adjustment of coupling or due to design considerations of the resonators. Each hole has a wall forming an additional surface area of the body, and a portion of each of these surface areas can be free of conductive coating forming non-conductive sections of the walls of the holes, similar to the original hole. The posts formed in these holes may be of different or similar height.

According to a second aspect, a system is provided. The system may be a filter or part of a filter. The system comprises at least two radio frequency resonators, each comprising a monoblock of dielectric material having a predetermined shape and including surfaces areas. The at least two radio frequency resonators include adjacent radio frequency resonators. The radio frequency resonators may be single-mode, dual-mode or multimode radio frequency resonators. The system further comprises at least one bridge for coupling the adjacent radio frequency resonators, the bridge being positioned between the adjacent radio frequency resonators and physically connected to opposing surface areas of the adjacent radio frequency resonators. The bridge is a bridge according to any of the first to eighth implementation forms of the first aspect or to the first aspect as such.

In a first possible implementation form of a system according to the second aspect, the length of the body of dielectric material is smaller than or equal to the width of the adjacent surface layer of the radio frequency resonator, and the bridge is configured to couple a resonant frequency between the adjacent radio frequency resonators. The maximum length of the body of dielectric material of the bridge is limited by the width of the adjacent surface layer, which length provides maximum coupling through the bridge.

In a second possible implementation form of a system according to the second aspect, the body of the bridge comprises an additional elongated part orthogonal to the elongated shape along the length of the body, with an additional hole disposed through the additional elongated part. The radio frequency resonators in this implementation form are multimode radio frequency resonators; and the bridge is configured to couple two orthogonal resonance modes of the adjacent multimode radio frequency resonators. This implementation form of the system can refer to the third implementation form of the bridge of the first aspect.

In a third possible implementation form of a system according to the second aspect as such or according to any previous implementation form of the second aspect, the monoblock of the radio frequency resonators comprises the same dielectric material as the body of the bridge. In a fourth possible implementation form of a system according to the third implementation form, this dielectric material is a ceramic material.

In a fifth possible implementation form of a system according to the second aspect as such or according to any previous implementation form of the second aspect, the system is a multiple-input and multiple-output (MIMO) system.

According to a third aspect, a method is provided for tuning a bridge coupling two radio frequency resonators. The bridge may be a bridge according to any implementation forms comprises a body of dielectric material having an exposed surface, predetermined length, width and thickness and having an elongate shape along the length of the body, and a conductive coating covering the exposed surface of the body. The method comprises: carving a hole through the body such that the dielectric material of the body surrounds the hole along the width of the body, wherein the diameter of the hole is smaller than the thickness of the body; coating the inner surface of the hole with a conductive layer; and selectively removing the conductive layer from a surface inside the hole, to form at least one non-conductive area on the monoblock surface.

The conductive layer may be removed from the surface inside the at least one hole by laser ablation. The conductive coating can be removed on a continuous scale, and the lowest resolution of removal is likely defined by the tool used and typically of the order of several microns. This allows the coupling that the bridge provides to be tuned. The removed conductive layer forms a post and the amount of removed material determines the height of the post, as described in further detail below.

According to a fourth aspect, a computer program is provided comprising means for implementing the method according to the third aspect.

Aspects and implementations listed above can enable the coupling of two modes in separate but adjacent resonators blocks to be precisely controlled. The control provided by the aspects of the disclosure can allow a full Radio Frequency/microwave filter to be manufactured out of a single piece of dielectric material.

Additionally, implementations of the aspects above allow parts to be produced that are more tolerant of manufacturing defects by allowing for more material to be included during the formation of a bridge without adversely affecting the resultant coupling. A further technical effect is providing a means to adjust the coupling between the two modes, coupled through the bridge, after manufacture in a controllable and predictable manner.

An additional advantage provided by aspects of the disclosure is that the means by which coupling adjustment is provided is compatible with existing or similar methods used for adjustment of other filter parameters by mechanical or laser ablation of a conductive coating. As such, the cost of introducing these new features to the production process is low.

The features are also designed so as to minimize the introduction of additional loss, in order to maintain filter performance. Particular care is taken to avoid additional loss through radiation so as to allow multiple units to operate adjacent to each other with minimal shielding, as in a MIMO system.

In addition to solving the described technical problem, the disclosure also greatly simplifies production complexity and therefore reduces cost. This enables more complex, compact and cost-effective full-system assembles based on these components to be designed and manufactured.

These features enable a solid multimode dielectric filter to be designed and produced as one homogenous component. Furthermore, the disclosure contributes to realizing the maximum potential performance of the filter by enabling it to be very accurately tuned, which, in turn, results in more compact filters or improved system performance.

For relatively narrow-band filters in particular; defined as those filters where the variation in coupling bandwidths due to manufacturing tolerances approach 20% of the filter bandwidth, the ability to tune the inter-resonator bandwidths is crucial for acceptable performance. As such, embodiments of the disclosure enable the design and implementation of very narrow-band designs that were previously impractical, of inadequate performance, or uneconomical to produce.

SHORT DESCRIPTION OF THE DRAWINGS

FIG. 1*a* shows the electrical and magnetic vectors for two modes in two radio frequency resonators connected by a bridge.

Figure 1B:
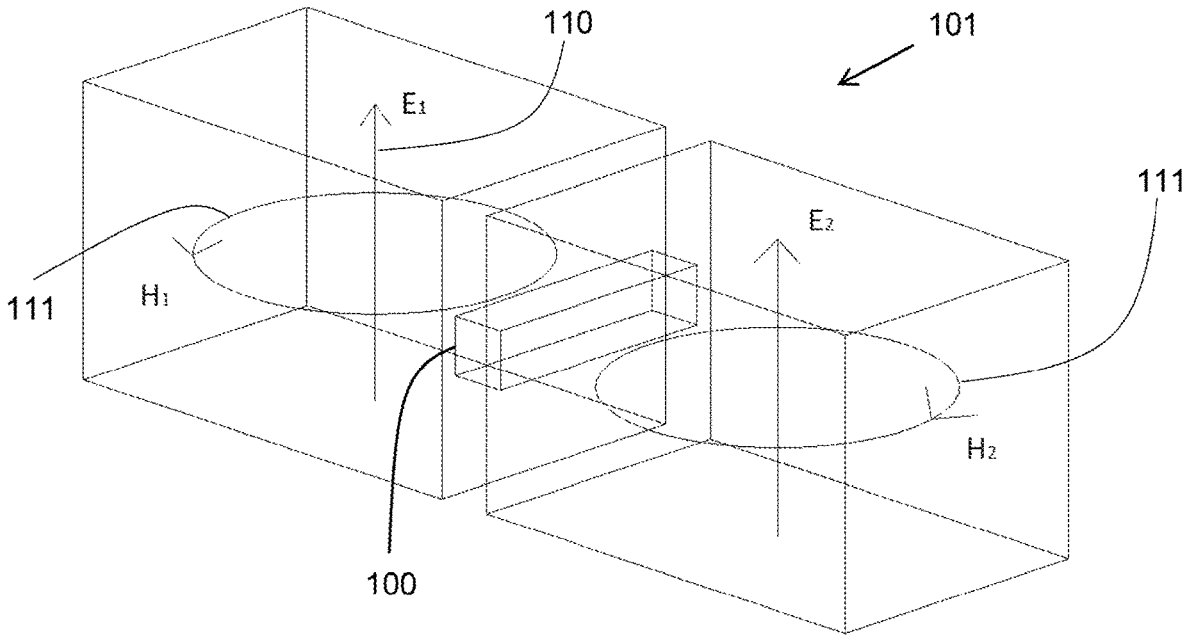

FIG. 1*b* shows the electrical and magnetic vectors for two modes in two radio frequency resonators of a different shape.

Figure 2A:
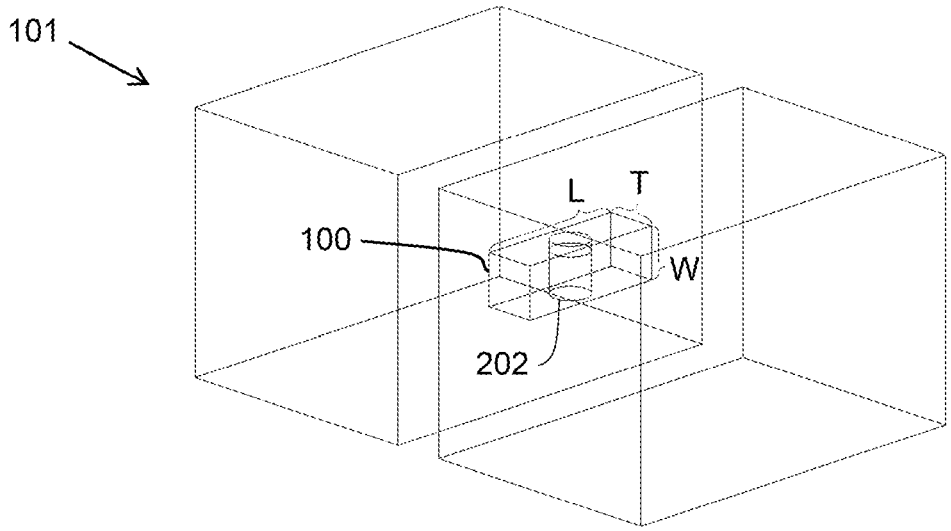

FIG. 2*a* is a perspective view of two radio frequency resonators connected by a bridge with a cylindrical hole according to an embodiment.

Figure 2B:
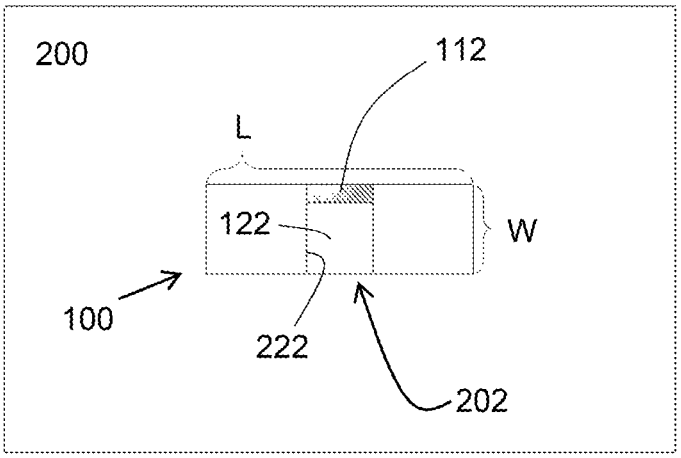

FIG. 2*b* is a side view of the bridge as shown on FIG. 2*a*.

Figure 3A:
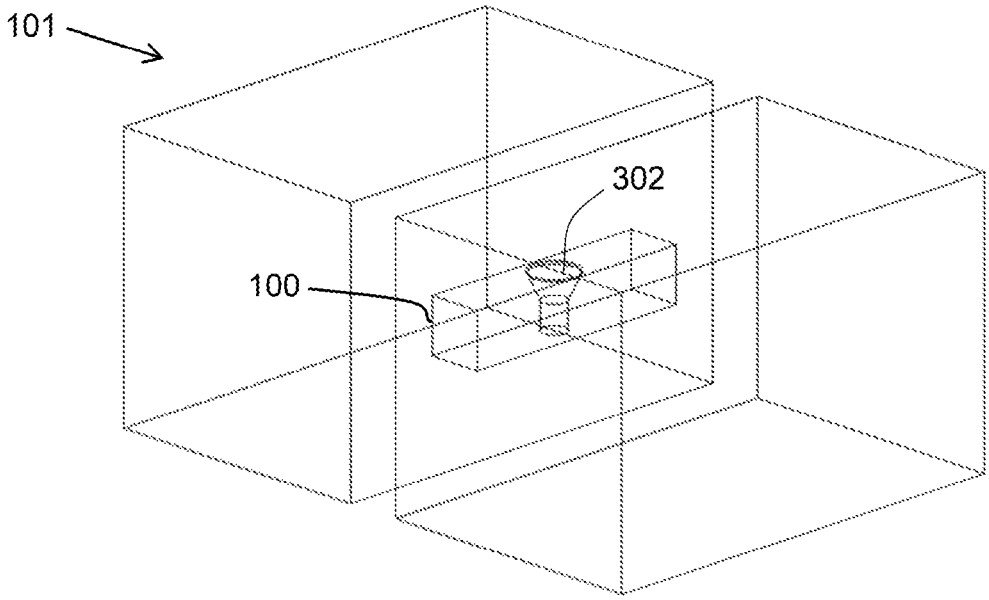

FIG. 3*a* is a perspective view of two radio frequency resonators connected by a bridge including a cylindrical hole with a conical top according to an embodiment.

Figure 3B:
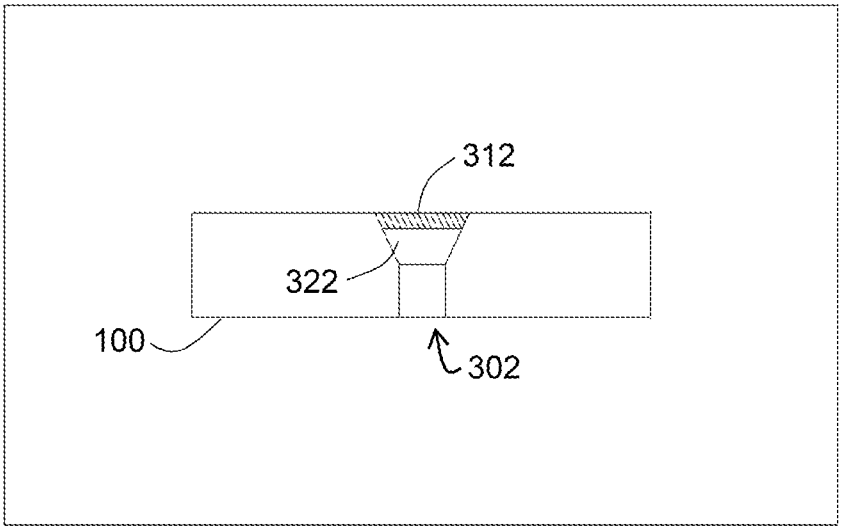

FIG. 3*b* is a side view of the bridge as shown on FIG. 3*a*.

Figure 4A:
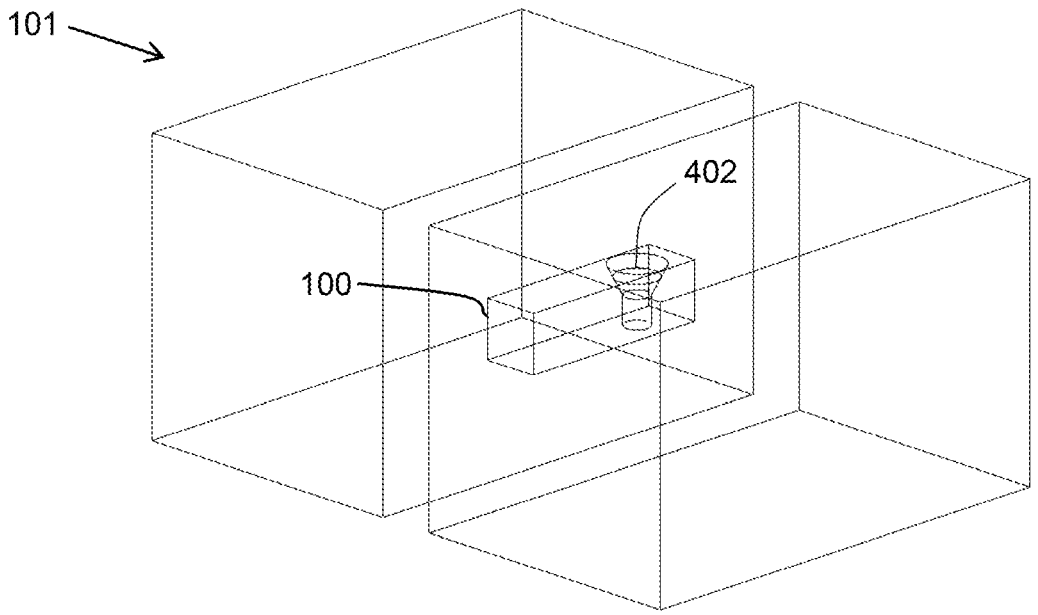

FIG. 4*a* is a perspective view of two radio frequency resonators connected by a bridge including a hole offset from the center according to an embodiment.

Figure 4B:
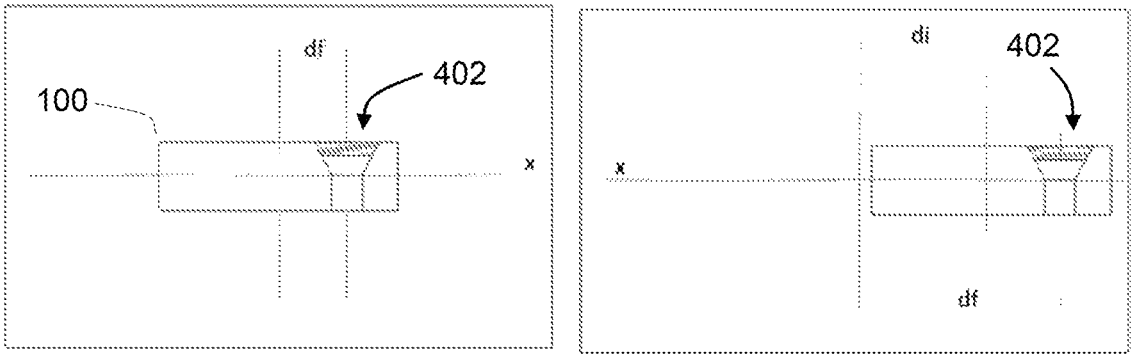

FIG. 4*b* is a side view of the bridge as shown on FIG. 4*a*.

Figure 5A:
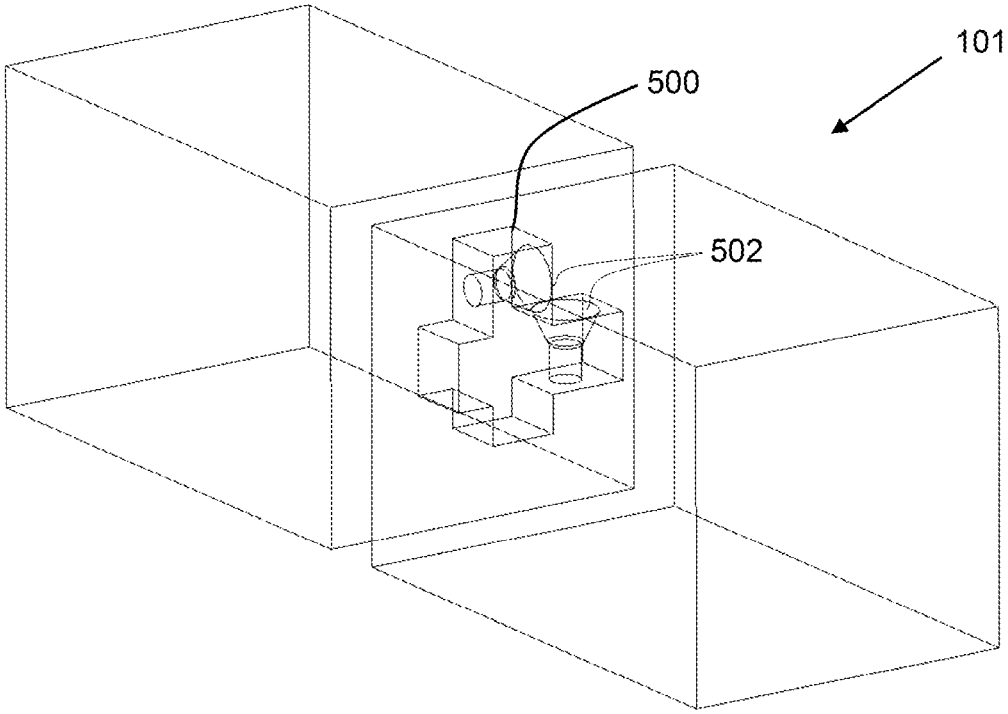

FIG. 5*a* is a perspective view of two radio frequency resonators connected by a bridge including two orthogonal holes according to an embodiment.

Figure 5B:
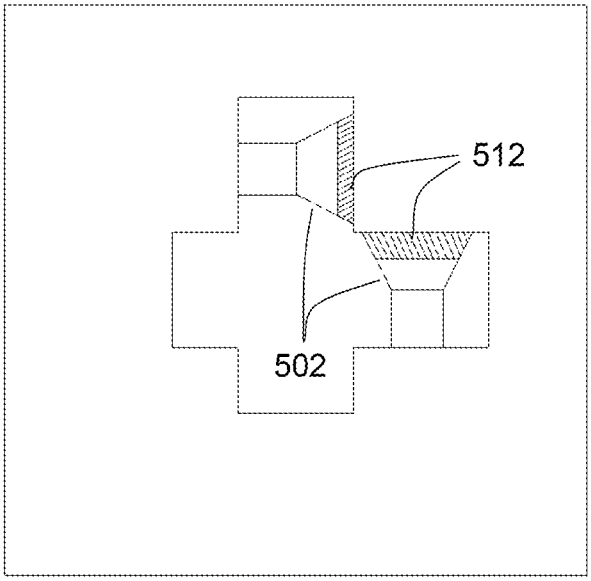

FIG. 5*b* is a side view of the bridge as shown on FIG. 5*a*.

Figure 6A:
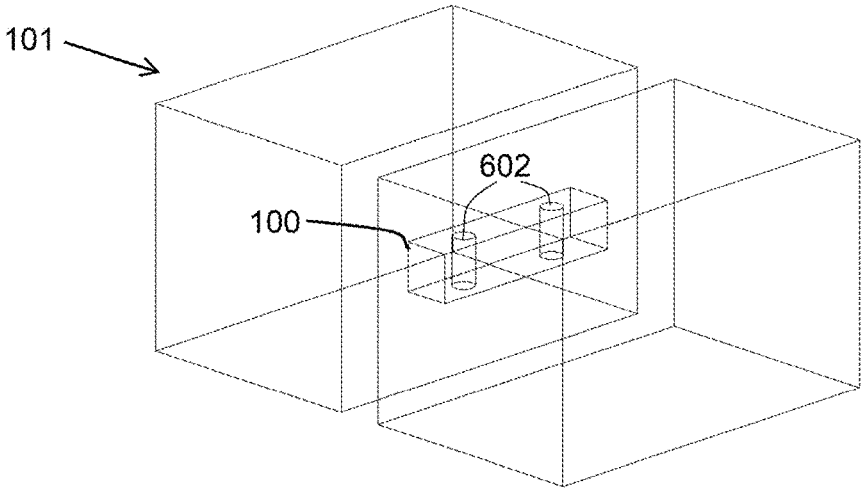

FIG. 6*a* is a perspective view of two radio frequency resonators connected by a bridge including multiple holes according to an embodiment.

Figure 6B:
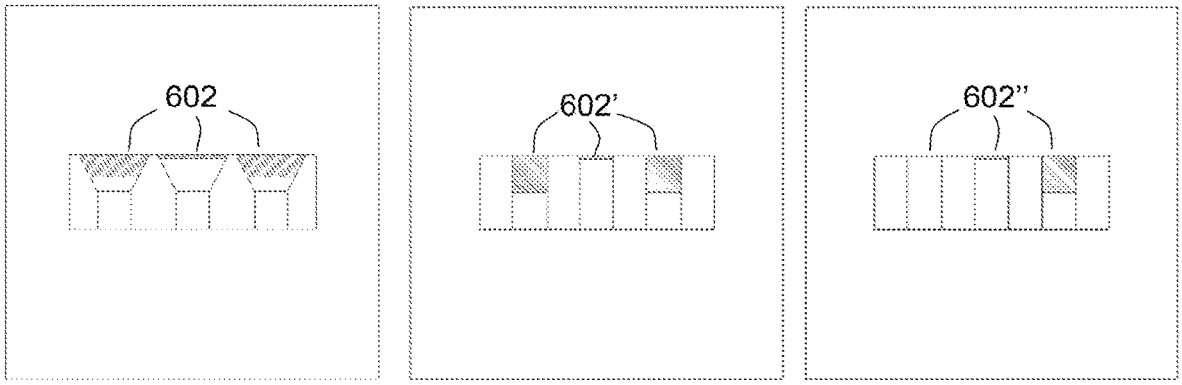

FIG. 6*b* provides side views of bridges similar to the bridge shown on FIG. 6*a*.

Figure 7:
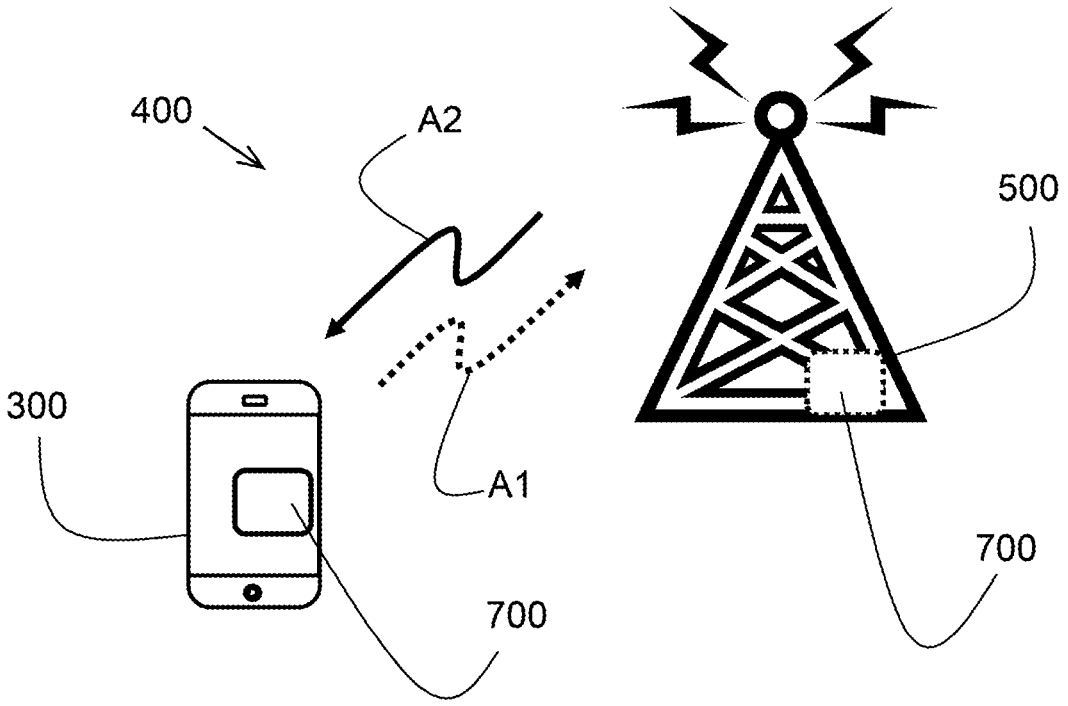

FIG. 7 shows schematically a communication device in a wireless communication system.

DETAILED DESCRIPTION

Below a description of embodiments will follow. In the following description of embodiments of the disclosure, the same reference numerals will be used for the same or equivalent features in the different drawings.

The embodiments described below relate to bridges for coupling radio frequency resonators that comprise a solid body of dielectric material. The body may be shaped as an elongate parallelepiped or as any other elongate shape that allows for coupling of two modes of adjacent resonators.

FIGS. 1*a* and 1*b* are simple illustrations of parallel resonant modes appearing in adjacent radio frequency resonators.

The magnetic and electric field configurations of parallel modes in adjacent radio frequency resonators 101 can be seen in FIGS. 1*a* and 1*b*. By coupling energy across two or more resonators 101 in a similar fashion, it is possible to use them to form a filter.

The magnetic fields H1, H2 indicated by field vectors 111 correspond to the electric fields E1 and E2 indicated by field vectors 110. As it is clear to a skilled person, since the magnetic field lines 111 follow the electric field lines 110, there are regions between the resonators 101 where the magnetic fields are parallel to each other. For example, H1 is substantially parallel to H2 near the adjacent edges of resonators 101. By placing an elongated iris bridge 100 between either the short or long wall of two adjacent resonator blocks, two parallel modes can be magnetically coupled together, for example H1 and H2 in FIGS. 1*a* and 1*b*.

In order for a bridge 100 positioned like this to provide a cheap, simple and effective means of accurately controlling and varying the coupling of the magnetic fields through it, while keeping the effect of variations in mechanical dimensions on the resultant electrical performance minimal, the bridge 100 includes additional features described in further detail in the embodiments below. The effect on resultant electrical performance is minimized to reduce sensitivity dimensional variations that result e.g. from an imprecise manufacturing process.

FIGS. 2*a*-2*b*, 3*a*-3*b*, 4*a*-4*b* and 5*a*-5*b* are all paired such that the first figure shows the bridge 100 implemented between adjacent resonators, and the second figure in the pair shows the embodiment outside of the structure.

For the purposes of this description, examples shown in the Figures are limited to dual-mode resonators of symmetrical parallelepiped shape, for clarity and consistency. As would be clear to a skilled person, all aspects of the disclosure are applicable without limitation to resonators of any other shape suitable for single-mode, dual-mode or multimode resonance.

FIG. 2*a* shows a bridge 100 disposed between two radio frequency resonators, forming the structure 101. FIG. 2*b* provides a zoomed-in side view 200 of the bridge 100. The bridge 100 comprises a body of dielectric material having an exposed surface area and a predetermined length L, width W and thickness T, indicated in FIGS. 2*a*-2*b*. The body of the bridge has an elongate shape along its length L. The shape may be a parallelepiped as shown in the Figures for clarity only, or any other suitable elongate shape. The bridge 100 further comprises a hole 202 disposed through the body along its width W. The hole 202 has a wall inside of it, forming a second surface area 222 of the body. The second surface area 222 has a first portion that is covered with a conductive coating, along with the exposed surface area of the body. The second surface area 222 also comprises a second portion 112 free of conductive coating. The conductive coating can be formed of a highly conductive material, for example metal.

The width W of the body of the bridge is chosen so as to be mechanically feasible to produce with the chosen manufacturing technique, but small enough to also result in minimal coupling between other resonant modes, for example the two modes that are orthogonal to the direction of the length of the bridge.

In the embodiment of FIGS. 2*a*-2*b*, a single cylindrical through hole 202 is disposed in the center of the bridge 100, with a diameter that is smaller than the thickness T of the bridge, and defined by the spacing between the two resonator blocks. The inner wall of the hole is completely covered in conductive coating, and provides a boundary condition for fields in both cavities in this completely coated form.

After manufacture, nominal coupling between the two modes is determined by a gap in the material between the through hole 202 and the edge of the bridge 100 along the thickness of the bridge 100. For many applications below 6 GHz and at bandwidths that can be considered narrow, the coupling will be minimal or zero. In order for the coupling to operate, a small amount of conductive coating is removed from the top section 112 of the conductively-coated inner surface 222 of the hole 202, forming a non-conductive post 122 as shown in FIG. 2*b*. The existing boundary condition of the post 122 changes as the conductive coating is removed, with the post 122 becoming an open-circuit stub, resonant at a frequency much higher than either of the frequencies of the modes to be coupled. Coupling between the two modes occurs with this stub acting as a bypass that serves to strengthen the coupling significantly. The coupling may initially be so much stronger than the coupling in a bridge 100 without a post 122, that it in some cases it may become unusable. Further removal of conductive coating causes the amount of coupling between the two modes to reduce. After approximately 25% of the inner wall 222 of the hole being non-conductive, the relation between height of the post 122 and the coupling bandwidth can become linear and reduce towards the nominal coupling of an equally sized bridge without a post as height of the post 122 tends towards zero. Accordingly, in an embodiment 25% or more of the wall 222 of the hole 202 is non-conductive, which allows for more precise and predictable control of the coupling between the resonators.

As the conductive coating that forms the top part of the post is also part of an external ground, the interior of the bridge 100 may become exposed to the air/environment. As all magnetic field vectors are perpendicular to the axis of the post where this hole is, minimal radiation (and therefore loss) will occur provided that the hole is small. For many sub-6 GHz applications, this hole diameter will typically be less than 2 mm. The lower limit of the hole diameter is determined by the manufacturing process.

FIGS. 3*a* and 3*b* illustrate an embodiment, wherein instead of a plain cylindrical hole in the iris bridge 100, a part of the hole 302 is formed as a cone 322. Similarly, part of the conductive coating on the inner wall of the hole 302 is removed. The cone 322 also presents a surface area 312 in the plane of the bridge length accessible to a tool that could further remove conductive coating in order to adjust the coupling. The tool could be a mechanical grinding tool, a laser ablation tool, or any other tool.

A cylindrical hole 202 can be easier to manufacture, while a hole 302 with a conical part 322 can provide better access for partial removal of conductive coating from its surface area. Conductive coating can be selectively removed in circles from the top of the conical section 312, similar to the cylindrical section in the embodiment of FIGS. 2*a*-2*b*. The coupling can initially be very large and decrease non-linearly, as previously, but eventually will tend towards a region of approximately linear tuning.

The angle of the conical surface of the hole 302 can be chosen based on the resolution of tuning required and the capability of the tuning tool, i.e. the smallest amount of material that can be removed in one circular path. When the accuracy of the tool is lower, a more shallow angle and greater upper cone diameter is used. This results in a reduced tuning range. The exact dimensions required will be unique to each design and should be optimized accordingly based on filter specifications, manufacturing process and available tuning tools.

FIGS. 4*a* and 4*b* illustrate an embodiment wherein the hole 402 in the body of the bridge 100 is offset from the center of the body. The hole 402 illustrated herein is a hole with a conical part like the hole 302 of FIGS. 3*a*-3*b*. However, as is clear to a skilled person, the hole may have any other shape.

FIG. 4*b* illustrates the offset (df) of the hole 402 along the x-axis coinciding with length. In an extension of this embodiment, the bridge 100 itself may also be offset (di), in addition to the offset (df). These two offsets (df, di) can be arbitrarily and independently set in any direction along the x-axis.

By offsetting the hole 402 its efficacy in adjusting coupling is reduced the closer it is to the iris bridge 100 wall. A reduced sensitivity may be desirable with a larger bridge 100 or for other design considerations.

FIGS. 5*a* and 5*b* show an embodiment wherein the bridge 500 is of an elongate shape in two orthogonal directions. Each orthogonal leg of the bridge is arranged to independently provide coupling between two adjacent vertical modes and two adjacent horizontal modes, respectively. In this embodiment the adjacent radio frequency resonators are dual-mode or multimode resonators.

Holes 502 are disposed in the orthogonal legs of the body of the bridge 500 to provide the tuning. In this example, a combination of through cylindrical holes combined with cones is used, however any combination of similar or different holes may be used for the same effect.

Owing to the central section of the iris bridge 500 being occupied by the material that forms the orthogonal structure, both holes 502 are offset from the center, as shown more clearly in FIG. 5*b*. Undesired harmonic couplings may also restrict the offsets of the holes 502. Removing sections of conducting coating from the top 512 of each of the holes 502, as in previous embodiments, allows for precise, selective and independent control of both horizontal and vertical coupling bandwidths, through horizontal and vertical legs of the iris bridge 500, respectively.

FIG. 6*a* shows a system 101 with a bridge 100 that comprises multiple parallel holes 602. FIG. 6*b* shows various examples of three parallel holes 602, 602', 602". In other examples, any number of holes may be disposed through the body of the bridge 100. An odd number may be preferred because an odd number of holes includes a central hole which allows for optimal control.

The disclosure in this embodiment can operate in various ways. The first one shown in the rightmost schematic of FIG. 6*b*, and shows one outermost through hole that has no conductive coating removed (un-tuned), and the other outermost through-hole having approximately 50% of the conductive coating removed from its inner wall, tuned to an initial fixed height of the post. This left post operates as an auxiliary tuner and sets a basic nominal tuning range for the bridge 100. A third, central post can then be tuned progressively until the desired coupling bandwidth is obtained.

This embodiment is especially suitable for small bandwidths and/or filters where multiple bandwidth variations may be required from the same physical part. It is also suitable when a manufacturing process that has significant physical variations and/or poor tolerances is used.

A second configuration of this embodiment is shown in the central and leftmost schematic of FIG. 6*b*. In these schematics, both outermost posts operate as auxiliary tuners and are tuned equally and symmetrically to set the nominal coupling value provided by the iris bridge 100. The center, main tuning feature, is then used to fine-tune the coupling bandwidth to the desired value.

This configuration is also useful where a greater range of tuning is required—either to enable the tuning of multiple filter bandwidths from a single common filter part or to enable the use of processes with poor tolerances. It will also have the effect of controlling the propagation of a third harmonic resonance, which may be useful in certain cases.

Both asymmetric and symmetric auxiliary hole configurations described above can be scaled to use any number of tuning holes, not limited by type, design or order. The selection and combination of features used will depend on design requirements and any associated constraints of a given design.

FIG. 7 shows schematically a communication device 300 in a wireless communication system 400. The communication device 300 comprises a system 700 of two or more radio frequency resonators coupled through a bridge according to any of the embodiments of the disclosure. The wireless communication system 400 also comprises a base station 500, which may also comprise a system 700 of two or more radio frequency resonators coupled by the bridges according to any one of the embodiments described above. The dotted arrow Al represents transmissions from the communication device 300 to the base station 500, which are usually called up-link transmissions. The full arrow A2 represents transmissions from the base station 500 to the communication device 300, which are usually called down-link transmissions.

The communication device 300 may be any of a user equipment (UE) in Long Term Evolution (LTE), mobile station (MS), wireless terminal or mobile terminal which is enabled to communicate wirelessly in a wireless communication system, sometimes also referred to as a cellular radio system. The UE may further be referred to as mobile telephones, cellular telephones, computer tablets or laptops with wireless capability. The UEs in the present context may be, for example, portable, pocket-storable, hand-held, computer-comprised, or vehicle-mounted mobile devices, enabled to communicate voice or data, via the radio access network, with another entity, such as another receiver or a server. The UE can be a station (STA), which is any device that contains an IEEE 802.11-conformant media access control (MAC) and physical layer (PHY) interface to the wireless medium (WM).

The communication device 300 may also be a base station, a (radio) network node, an access node or an access point, e.g., a Radio Base Station (RBS), which in some networks may be referred to as transmitter, "eNB", "eNodeB", "NodeB" or "B node", depending on the technology and terminology used. The radio network nodes may be of different classes such as, e.g., macro eNodeB, home eNodeB or pico base station, based on transmission power and thereby also cell size. The radio network node can be a station (STA), which is any device that contains an IEEE 802.11-conformant media access control (MAC) and physical layer (PHY) interface to the wireless medium (WM).

Embodiments of the application are compatible at least with three-axis machining and high-volume, molded manufacturing methods such as, but not limited to, single axis isostatic-pressing, die-pressing, vacuum forming, superplastic forming, injection-molding, 3D printing, etc. The conductive material removal from any of the elements described in the embodiments above may be performed by laser ablation, mechanical grinding or any other suitable technique.

What is claimed is:

1. A bridge for coupling two radio frequency resonators, the bridge comprising:

a body of dielectric material having an exposed first surface area, the body having an elongate shape and comprising an additional elongated part orthogonal to the elongate shape;

a first hole disposed through the body, the first hole having a wall forming a second surface area of the body;

an additional hole disposed through the additional elongated part, wherein the additional hole is orthogonal and symmetrical relative to the first hole; and a conductive coating covering the exposed first surface area of the body and a first portion of the second surface area of the body;

wherein a second portion of the second surface area is free of conductive coating, so as to form a non-conductive section of the wall of the first hole.

2. The bridge according to claim 1, wherein the first hole is disposed through a central area of the body.

3. The bridge according to claim 1, wherein the first hole is disposed through an area offset from the center of the body.

4. The bridge according to of claim 1, wherein the first hole has a cylinder shape, and a diameter of the cylinder shape is smaller than a thickness of the body.

5. The bridge according to of claim 1, wherein the second portion of the second surface area covers at least 25% of the wall of the first hole.

6. The bridge according to claim 1, wherein the body of dielectric material has a predetermined length, a predetermined width, and a predetermined thickness;

wherein the elongate shape is along the length of the body; and wherein the first hole is disposed through the body along the width of the body.

7. The bridge according to claim 1, wherein the non-conductive section of the wall of the first hole extends from an edge of the first hole into the first hole.

8. The bridge according to claim 7, wherein the first hole comprises a cylinder shape and a conical top, wherein the conical top is proximate to the edge of the first hole from which the non-conductive section of the wall of the first hole extends into the first hole.

9. A system, comprising:

two radio frequency resonators, each comprising a monoblock of dielectric material having a predetermined shape and including surfaces areas; and a bridge for coupling the two radio frequency resonators, the bridge being positioned between the two radio frequency resonators and physically connected to opposing surface areas of the two radio frequency resonators;

wherein the bridge comprises:

a body of dielectric material having an exposed first surface area, an elongate shape, and an additional elongated part orthogonal to the elongate shape;

a first hole disposed through the body, the first hole having a wall forming a second surface area of the body;

an additional hole disposed through the additional elongated part; and a conductive coating covering the exposed first surface area of the body and a first portion of the second surface area of the body;

wherein a second portion of the second surface area is free of conductive coating, so as to form a non-conductive section of the wall of the first hole;

wherein the two radio frequency resonators are multimode radio frequency resonators; and wherein the bridge is configured to couple two orthogonal resonance modes of the two radio frequency resonators.

10. The system according to claim 9, wherein a length of the body of dielectric material of the bridge is smaller than or equal to a width of an adjacent surface layer of a radio frequency resonator of the two radio frequency resonators; and wherein the bridge is configured to couple a resonant frequency between the two radio frequency resonators.

11. The system according to claim 9, wherein the system is a multiple-input and multiple-output system.

12. The system according to claim 9, wherein the body of dielectric material has a predetermined length, a predetermined width, and a predetermined thickness;

wherein the elongate shape is along the length of the body; and wherein the first hole is disposed through the body along the width of the body.

13. The system according to claim 9, wherein the monoblocks of the two radio frequency resonators comprise the same dielectric material as the body of the bridge.

14. The system according to claim 13, wherein the dielectric material is a ceramic material.

* * * * *